US005494566A

United States Patent [19]

Gould et al.

[11] Patent Number: 5,494,566

[45] Date of Patent: Feb. 27, 1996

[54] LUBRICATING OIL DEWAXING WITH MEMBRANE SEPARATION OF COLD SOLVENT

[75] Inventors: Ronald M. Gould, Sewell; Albert R. Nitsch, Princeton, both of N.J.

[73] Assignee: Mobil Oil Corporation, Fairfax, Va.

[21] Appl. No.: 249,610

[22] Filed: May 26, 1994

[51] Int. Cl.[6] ..... C10G 73/06; C10G 73/32

[52] U.S. Cl. ..... 208/33; 208/31; 208/37; 208/38; 210/500.39; 210/654; 585/818; 585/819

[58] Field of Search ..... 208/31, 33, 37–38; 210/500.39, 654; 585/818, 819

[56] References Cited

U.S. PATENT DOCUMENTS

| | | | |
|---|---|---|---|
| 2,655,486 | 10/1953 | Greene | 202/42 |
| 4,898,674 | 2/1990 | Pasternak et al. | 210/500 |
| 5,264,166 | 11/1993 | White et al. | 264/41 |
| 5,358,625 | 10/1994 | Gould et al. | 208/31 |
| 5,360,530 | 11/1994 | Gould et al. | 208/31 |

*Primary Examiner*—Helane Myers

*Attorney, Agent, or Firm*—Alexander J. McKillop; Malcom D. Keen; L. Gene Wise

[57] ABSTRACT

A process for solvent dewaxing petroleum feedstock to separate crystallized wax from lubricant oil by filtration of a wax/oil/solvent mixture. The feedstock is sequentially cooled and mixed with cold polar solvent to form a wax crystal phase and oil-solvent phase, and-the oil-solvent filtrate stream is contacted with solvent permeable selective membrane at low temperature to recover an internal circulating permeate solvent stream and an oil-rich retentate stream containing dewaxed oil product and residual solvent. Improved operation is achieved by splitting the internal circulating solvent stream into a multiple cold solvent recycle streams and injecting a plurality of the cold solvent recycle streams into the waxy petroleum feedstock during sequential cooling and mixing. By initially injecting a cold recycle solvent stream in to the waxy petroleum feedstock at a small temperature differential near the wax crystallization temperature, shock cooling and excess small wax crystal formation is avoided.

11 Claims, 1 Drawing Sheet

LUBRICATING OIL DEWAXING WITH MEMBRANE SEPARATION OF COLD SOLVENT

BACKGROUND OF THE INVENTION

The present invention is directed to a process for dewaxing waxy oil feeds. This invention is particularly directed to a process for dewaxing waxy petroleum oil fractions.

Solvent dewaxing of waxy petroleum oil feeds to obtain lubricating oil stocks includes the step of contacting a cold oil/solvent filtrate stream from a solvent dewaxing process with a selective permeable membrane to selectively separate the cold oil/solvent filtrate into a cold solvent permeate stream and a cold filtrate stream. Part of the cold solvent permeate stream is used to improve unit heat integration and to provide incremental warm dilution. The remainder is recycled to an oil/solvent/wax feed to the wax filtration step. The separated cold filtrate stream is contacted by indirect heat exchange with warm waxy oil feed to cool the warm waxy oil feed.

In solvent dewaxing of petroleum lubricant range hydrocarbons, cold solvent is typically added to a hot waxy raffinate to control crystallization of the wax in the feed. Usually there is a large temperature differential ($\Delta T>20°$ C.), which results in non-optimum wax crystallization rate and loss of yield. Chilling of the feed is accomplished by indirect heat exchange against cold filtrate from the dewaxing filters and with refrigerant. Solvent for recycle is usually recovered at large expenditure of energy from the filtrate by a combination of heating, multi-stage flash vaporization, and distillation operations. The hot solvent so recovered is then chilled again at considerable expense to the desired temperature for recycling to the wax filter feed.

In a conventional solvent dewaxing process a waxy oil feed is mixed with solvent from a solvent recovery system. The waxy oil feed/solvent mixture is cooled by indirect heat exchange in a scraped-surface, double pipe heat exchanger against cold filtrate, which is a mixture of oil and solvent recovered from a filter used to separate wax from a wax containing stream. The cold filtrate is a mixture of oil and solvent. The cooled feed mix is injected with additional cold solvent from the solvent recovery system. The resultant mixture is further cooled against vaporizing propane, ammonia, or other refrigerant gas in a second scraped-surface double pipe exchanger. The chilled feed slurry is mixed with more chilled solvent from the solvent recovery system to obtain a filter feed.

The amount of circulating solvent is typically limited by either the capacities of the solvent recovery sections or the capacity of the refrigeration system used to cool the recovered solvent to the desired injection temperatures. These limitations on the solvent availability can restrict the feed rate to the filter since the filter feed (high viscosity oil plus low viscosity solvent) must have a sufficiently low viscosity to achieve an acceptable filtration rate. A circulating solvent temperature significantly different from that of the charge mix at the point of injection can lead to shock chilling.

In current practice, dewaxing of waxy feed is performed by mixing the feed with a solvent to completely dissolve the waxy feed at a suitable elevated temperature. The mixture is gradually cooled to an appropriate temperature required for the precipitation of the wax and the wax is separated on a rotary filter drum. The dewaxed oil is obtained by evaporation of the solvent and is useful as a lubricating oil of low pour point. Accordingly, the dewaxing apparatus is expensive and complicated. In many instances the filtration proceeds slowly and represents a bottleneck in the process because of low filtration rates caused by the high viscosity of the oil/solvent/wax slurry feed to the filter. The high viscosity of the feed to the filter is due to a low supply of available solvent to be injected into the feed stream to the filter. In some cases, lack of sufficient solvent and/or inappropriate injection temperature can result in poor wax crystallization and ultimately lower lube oil recovery.

Use of solvents to facilitate wax removal from lubricants is very energy intensive, due to the requirement for separating from the dewaxed oil and recovery of the expensive solvents for recycle in the dewaxing process. The solvent is conventionally separated from the dewaxed oil by the addition of heat, followed by a combination of multistage flash and distillation operations. The separated solvent vapors must then be cooled and condensed and further cooled to the dewaxing temperature prior to recycle to the process. Serious limiting factors in the conventional solvent dewaxing process are the cost and size of the filters, the cost, size, and operating expense of the distillation equipment needed to separate the solvent from the dewaxed oil, and the cooling apparatus and cooling capacity required to cool the warm solvent separated from the dewaxed oil. The filter capacity could be increased if there were available more solvent by simply further diluting the oil/solvent/wax mixture feed to the filter to lower the viscosity of the feed, and if crystallization were better controlled. However, increasing the amount of solvent available to dilute the feed to the filter requires increasing the means of heating and separating solvent from dewaxed oil and increasing the cooling capacity to cool the separated warm solvent prior to recycle.

Problems to be solved include increasing the amount of solvent available to the solvent dewaxing process without increasing the overall solvent inventory and without increasing the size and capacity of the oil/solvent recovery distillation system and the refrigeration capacity required to cool the warm solvent separated by distillation and to simultaneously provide pre-dilution solvent at higher temperature. An additional problem is to increase the filtration capacity of the process without providing additional filtration apparatus.

It is an important object of the present invention to increase the amount of dewaxing solvent available to the dewaxing process by increasing the rate of recycle of the solvent to the process. Particularly, the ratio of internal circulating solvent to solvent recovered by vaporization from oil product can be increased to more than 3:1 Accordingly, it is another object of the present invention to increase the amount of dewaxing solvent available to the dewaxing process without increasing the distillation capacity of the oil/solvent recovery system and without increasing the refrigeration capacity required to cool to the dewaxing temperature warm solvent recycled from the oil/solvent recovery system to the dewaxing process.

It is another object of the present invention to utilize a selective permeable membrane to contact cold oil/solvent filtrate from the filter to selectively separate the cold filtrate into a cold solvent permeate stream and a cold filtrate retentate stream which contains the dewaxed oil and the remaining solvent and to recycle the cold solvent permeate stream to the filter feed stream. Yet another object is to increase the oil/solvent/wax slurry filtration rate by increasing the solvent recycle to the filter feed stream and decreasing the viscosity of the oil/solvent/wax slurry feed to the filter.

A further object is to reduce the required distillation capacity of the solvent recovery distillation operations.

Another object is to increase filter rate by controlling wax crystal growth. A significant advantage of this invention is minimizing membrane area.

SUMMARY OF THE INVENTION

The present invention is directed to a process for solvent dewaxing a waxy oil feed to obtain petroleum oil lubricating stock. The waxy oil feed is diluted with solvent at the feed temperature, then is sequentially indirectly contacted with cold filtrate, cold solvent, and refrigerant which reduce the temperature of the oil to crystallize and precipitate the wax constituents of the oil and is then directly contacted stagewise with progressively colder solvent streams to obtain an oil/solvent/wax mixture. The directly added solvent also serves to dilute the oil/solvent/wax mixture in order to maintain a sufficiently low viscosity of the mixture such that the mixture, when fed to a filter, is readily separated into a wax/solvent slurry and a cold dewaxed oil/solvent filtrate stream.

The total amount of solvent added to the waxy oil feed, i.e. the solvent/oil ratio used, and the temperature to which the waxy oil feed is cooled are determined by the boiling range of the feed, the wax content of the feed, and the desired pour point of the dewaxed lubricating oil.

The process includes contacting the dewaxed oil/solvent filtrate stream with a selective permeable membrane to selectively separate the filtrate stream into a solvent permeate stream and a filtrate stream which contains the dewaxed oil and the remaining solvent. The solvent permeate stream is recycled to the filter feed stream. The filtrate stream is then indirectly contacted with the waxy oil feed to cool the waxy oil feed.

In order to increase the rate of solvent transfer through the membrane, the oil/solvent filtrate stream side of the membrane is maintained at a positive pressure relative to the solvent permeate stream side of the membrane.

The recycle of the solvent permeate stream to the filter feed stream substantially increases the amount of solvent available to the dewaxing process and increases the filter feed rate.

The warm waxy oil feed is cooled in a heat exchanger by indirect heat exchange first with the cold filtrate and then the cold permeate to crystallize and precipitate the wax in the oil feed to form an oil/solvent/wax mixture. The now warmed permeate is used to further dilute feedstream. The oil/solvent/wax mixture is further cooled in a heat exchanger by indirect heat exchange with a cold refrigerant. The cold oil/solvent/wax mixture is further diluted with cold recycled permeate solvent to adjust the viscosity of the mixture and the mixture is fed to a filter which filters and removes the precipitated wax from the cold oil/solvent/wax mixture. A cold wax/solvent slurry is recovered and a cold dewaxed oil/solvent filtrate stream is recovered.

The wax/solvent slurry is treated to recover a wax cake which can be further treated and washed with solvent to remove residual oil from the wax cake. The oil can be separated and recovered from the solvent wash stream and the solvent can be recycled.

The cold oil/solvent filtrate stream is fed, at the filtration temperature, to a selective permeable membrane. The membrane selectively separates the cold filtrate into a cold solvent permeate stream and a cold filtrate stream which contains the dewaxed oil and the remaining solvent. The cold solvent permeate stream at the filtration temperature is recycled to the filter feed stream. The cold filtrate stream is fed to a heat exchanger to indirectly contact and cool the warm waxy oil feed.

The separation and recycle of cold solvent from the oil/solvent filtrate stream to the filter feed achieves a substantial reduction in the amount of solvent that must be separated from the oil/solvent filtrate stream in the oil/solvent separation operation.

Several advantages are depicted in the drawing and detailed description for using part of cold permeate for indirect heat exchange. The cold oil/solvent filtrate stream, after the selective removal of the solvent through the permeable membrane is sent to an oil/solvent separation operation in which the remaining solvent is removed by distillation from the dewaxed oil, cooled and recycled to the dewaxing process and the dewaxed lubricating oil product is recovered. A substantial portion of the cold solvent in the filtrate stream is transferred through the selective membrane and recycled directly to the filter feed.

BRIEF DESCRIPTION OF THE DRAWINGS

The FIG. 1 is a schematic process flow diagram showing the solvent dewaxing process of the present invention including incremental cooling and incremental solvent addition to a warm waxy oil feed, filtration of wax, a selective permeable membrane for separating solvent from filtrate and recycle of solvent to both the indirect exchangers and the filter feed, and recycle of recovered solvent from an oil/solvent recovery operation.

The feed to the process of the present invention can comprise any liquid hydrocarbon containing a dissolved or partially dissolved wax component from which it is desired to remove part or all of the wax component. The feed stream typically consists essentially of petroleum lubricating oil raffinates obtained from extraction of distillates and/or deasphalting of vacuum tower distillates. The waxy oil feed to the present process is typically a waxy lubricating oil fraction which boils in the range of 580° F. to 1300° F. The fraction boiling from about 580° F. to 850° F. is generally referred to as light lubricating oil distillate. The fraction boiling from about 800° F. to about 1050° F. is generally referred to as heavy lubricating oil distillate. The fraction boiling from about 1050° to about 1300° F. is generally referred to as residual deasphalted oil.

Figure 1:
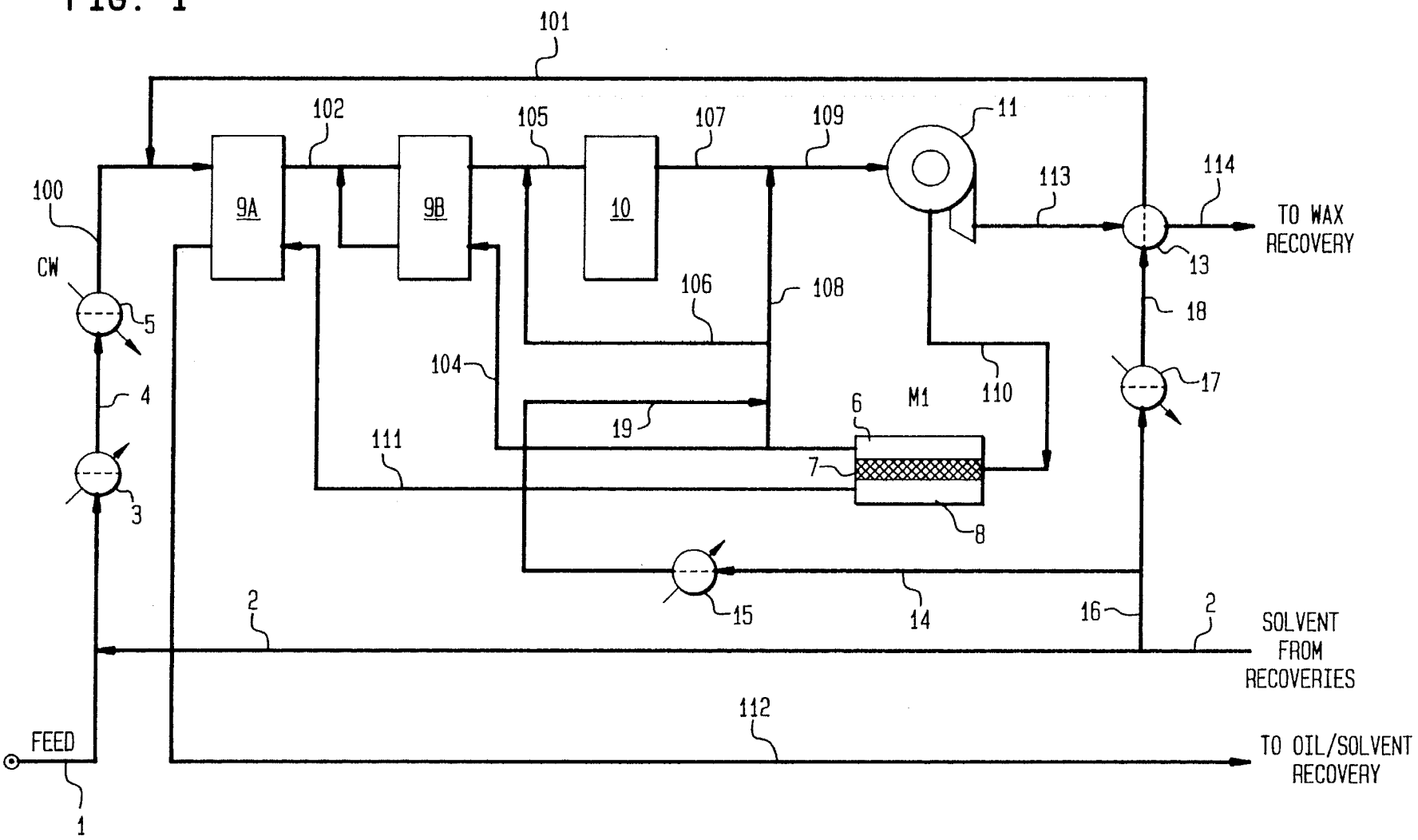

The distillate lubricating oils fed to the process of the present invention, prior to solvent dewaxing, are treated by solvent-extraction processes to remove aromatic and, if needed, asphaltenic compounds. The aromatic solvent extraction step can be carried out using a conventional phenol, furfural or n-methyl-pyrolidone solvent extraction procedure. Deasphalting processes use phenol and/or light hydrocarbon solvents, such as propane or butane. The waxy oil feed to the solvent dewaxing process of the present invention is, accordingly, relatively free of polycyclic aromatic hydrocarbons.

During the dewaxing process, the hydrocarbon feed is diluted with a first portion of solvent and then heated to a temperature to effectively dissolve all of the wax present in the feed. The warm feed is then indirectly cooled with cold water by conventional cooling means such as a tubular heat exchanger.

The still warm waxy oil feed is then cooled by indirect heat exchange with cold filtrate. It is then diluted with fresh solvent, cooled by indirect heat exchange against the same solvent and with cold refrigerant, then is further cooled and diluted by direct injection of cold recycle solvent permeate from the membrane recovery operation. Advantageously, the initial cold solvent is injected at a small temperature differential, typically less than 5° C. (9° F.), to control crystal formation. This ΔT can be achieved by precooling the waxy feedstock at or near the wax crystallization temperature, while passing the cold solvent permeate stream in indirect heat exchange with downstream oil/wax, thus warming the solvent to slightly below wax crystallization temperature prior to initial injection. The waxy oil feed is thus sequentially cooled and diluted to its desired wax filtration temperature, which temperature is selected to achieve a desired pour point for the dewaxed oil product.

An oil/solvent/wax mixture is obtained and is further diluted with solvent to adjust the viscosity of the mixture and the mixture is fed to a filter which removes the wax from the oil/solvent/wax mixture. A cold wax cake is recovered and a cold oil/solvent filtrate stream is recovered. The cold oil/solvent filtrate is fed to a selective permeable membrane. The membrane selectively separates the cold filtrate into a solvent permeate stream and a cold filtrate stream which contains the dewaxed oil and the remaining solvent. The cold solvent permeate stream at the filtration temperature is recycled to the filter feed stream. The cold filtrate stream is then contacted with the warm waxy oil feed by indirect heat exchange.

After heat exchange with the warm waxy oil feed, the filtrate is sent to an oil/solvent separation operation in which the remaining solvent is removed from the dewaxed oil and recycled to the dewaxing process and the wax free lubricating oil stock product is recovered.

Typical distillate feeds to the process of this invention are:

| | Approximate Boiling Range |
|---|---|
| Light Neutral Lubricating Oil Feed Stock | 580–850° F. |
| Heavy Neutral Lubricating Oil Feed Stock | 850–1050° F. |
| Deasphalted Lubricating Oil Feed Stock | 1050–1300° F. |

The term cloud point as used herein is intended to mean the temperature at which wax crystallization begins to occur, and the term pour point is the minimum temperature at which the oil will first move in a standard tube after quickly turning the tube on its side following a standard chilling procedure as set forth in ASTM test method D-97.

The dewaxing solvents used in the present invention can be an aliphatic ketone, such as acetone, methyl ethyl ketone (MEK), diethyl ketone, methyl n-propyl ketone, methyl isopropyl ketone, methyl-n-butyl ketone, methyl isobutyl ketone or other lower aliphatic ketones and mixtures thereof. The solvent also can include an aromatic solvent such as benzene, toluene, xylene and the like. The preferred solvent is a mixture of methyl ethyl ketone and toluene.

The dewaxing solvent used in the present invention performs several important functions. The solvent dilutes the waxy oil feed and dissolves the oil component, cools the oil feed to the dewaxing temperature and lowers the solubility of the wax in the oil, forms a wax precipitate having a crystalline structure that facilitates separation of the wax from the oil and solvent in a filtration step and maintains a desired low viscosity to facilitate handling and processing of the oil/solvent/wax mixture through the heat exchangers and filters used in the process.

The process of the present invention, in a preferred embodiment, employs a mixture of MEK and toluene solvents. The MEK has poor solvent power for wax and relatively good solvency for oil. The toluene is included to increase oil solubility at dewaxing temperatures and to reduce oil/solvent solution viscosity to improve its filterability.

The use of solvents with high ketone content is beneficial because it increases filter rates by virtue of its lower viscosity and it reduces the dewaxing temperature differential between filtration temperature and pour point of dewaxed oil due to its lower wax solution power relative to toluene. The volume percent ratio of MEK/toluene can be 25:75 to 100:0, preferably 40:60 to 80:20 and typically about 65:35. The preferred ratios depend on the waxy oil raffinate feed to be dewaxed. For dewaxing of light neutral lube oil feed stock the ratio of MEK/toluene can be 65:35 to 95:5; for dewaxing heavy neutral lube oil feed stock the ratio of MEK/toluene can be 50:50 to 75:25, and for dewaxing deasphalted lube oil feed stock the ratio of MEK/toluene can be 40:60 to 70:30.

The solvent is added to the waxy oil feed sequentially at a number of injection points in the chilling train. The manner of solvent addition affects crystal size and subsequent filtration rates. Large, well defined crystals result in high filter rates and good washing efficiency with a corresponding high dewaxed oil yield and a low oil content wax product. Small or ill-defined crystals form a cake with resultant poor filtration characteristics which lead to lower dewaxed oil yields, poor wax quality and reduced oil production rates.

All solvent additions made at or below the cloud point temperature should be made at about the same temperature as the oil/solvent/wax to which it is added to avoid shock chilling which promotes formation of fine, difficult to filter crystals.

The table below shows a typical dilution schedule for a light and a heavy neutral distillate stock.

TABLE 1

| Addition Point[1] | Light Neutral Lubricating Oil Feed Stock[3] | Amount of Diluent Added[2] Solvent Oil Ratio Vol. % Heavy Neutral Lubricating Oil Feed Stock[4] |
|---|---|---|
| Primary (Line 2) | 50 | 70 |
| Recycle (Line 102) | 100 | 150 |
| Recycle (Line 104) | 30 | 0 |
| Recycle (Line 106) | 100 | 100 |

[1]See FIG. 1 of drawing.
[2]Solvent addition is based on a 10,000 BD lube dewaxing plant.
[3]Ratio MEK/tol. 75/25
[4]Ratio MEK/tol. 60/40

The solvent is added step-wise during the process in order to maintain the viscosity of the oil/solvent/wax mixture at a desirable low level to facilitate handling and processing of the mixture through the scraped surface double pipe heat exchangers and the filtration of the wax in the filter apparatus. The total solvent dilution to oil feed ratio will depend to a large extent on the wax content of the feed, the viscosity of the feed and the desired pour point of the dewaxed oil product. The term total solvent to oil dilution ratio as used herein is intended to mean the total volume of the solvent that is added to the initial volume of the oil feed during the dewaxing process. The total solvent to oil ratio can, accordingly, be 6:1 to 1:1, typically 4:1 to 3:1, depending on the nature and viscosity of the waxy oil feed.

The dewaxing temperature is the temperature at which the oil/solvent/wax mixture is fed to the rotary filter drum and depends primarily on the desired pour point of the dewaxed oil product. Typical dewaxing temperatures for light neutral lubricating stocks are −23° C. to −18° C., and for heavy neutral stocks are −18° C. to −7° C.

The filterability of oil/solvent/wax mixtures is dependent to a great extent on the size and shape of the wax crystals. Crystal growth can be affected by use of low chilling rates and high solvent concentrations. Dewaxing aids or wax crystal modifiers have been found effective in dewaxing of certain heavy lube oil stocks. These can be either nucleating agents that initiate crystal growth or growth modifiers that affect crystal growth. The crystals that are obtained are compact and are more readily separated from the oil. The conventional dewaxing aids can be used in the present process.

In the present invention, a membrane module comprised of either hollow fibers or spiral wound or flat sheets is used to selectively remove cold solvent from the filtrate for recycle to the filter feed. The selective separation of the solvent and the recycle of the permeate solvent to the filter feed are both carried out at the filter temperature or at about the filter temperature. The optimum level of solvent removal is a function of filter feed properties and unit specific operating constraints. The present invention allows a significant increase in waxy oil feed rate to a dewaxing plant by debottlenecking the filtration, refrigeration and oil recovery sections of the plant.

For the solvent-oil separation of the present invention, the membrane materials that can be used include, but are not limited to isotropic or anisotropic materials constructed from polyethylene, polypropylene, cellulose acetate, polystyrene, silicone rubber, polytetrafluoroethylene, polyimides, or polysilanes. Asymmetric membranes may be prepared by casting a polymer film solution onto a porous polymer backing, followed by solvent evaporation to provide a permselective skin and coagulation/washing. A suitable polyimide, based on 5(6)-amino-1-(4'-aminophenyl)-1,3-trimethylindane, is commercially available as "Matrimid 5218". The membrane can be configured as either a flat sheet (plate and frame), hollow fiber, or spiral wound module. For the present invention, a spiral wound module is preferred due to its balance between high surface area and resistance to fouling. Typical construction of such a module comprises layers of the selected membrane wound upon a perforated metal or solvent resistant tube. The membrane layers would be separated by alternate layers of permeate and retentate spacers sized to provide an acceptable pressure drop from inlet to outlet of typically 2–10 psig. Appropriate adhesives and sealants designed to maintain separate permeate and retentate flow channels and to minimize structural rearrangement upon use complete the construction. Modules of any size can be constructed, but typically are 8–10 inches in diameter and 48 inches long having 200–300 $ft^2$ surface area. Feed flow to each module varies according to application but is on the order of 8,000–10,000 gal/day; the corresponding permeate rate is on the order of 1,000–2,000 gal/day. Typical transmembrane pressure drop is about 400–600 psi. A commercial installation will vary in size with application and specific membrane performance but will typically employ on the order of 500–1500 modules for a world scale lube dewaxing plant. It is recognized that a multiplicity of membrane modules can be used either in series or in parallel or any combination of multi-stage parallel units within this arrangement.

Selective permeable membranes useful for the present process are disclosed by Pasternak in U.S. Pat. No. 4,985,138; Winston, et al, U.S. Pat. No. 4,990,275; Thompson, et al. U.S. Pat. No. 4,368,112 and I-F Wang et al. U.S. Pat. No. 5,067,970. A preferred membrane is disclosed by L. S. White et al in U.S. Pat. No. 5,264,166.

The feed mixture flows through the scraped-surface double pipe heat exchangers and is cooled by indirect heat exchange with cold filtrate and/or solvent. The wax crystallization begins in the first of two or more such heat exchangers. The cold surface of the heat exchanger is continually scraped to remove crystallized wax and to maintain the wax dispersed in the oil/solvent liquid.

A second type of scraped-surface double pipe heat exchanger that can be used is one in which a vaporizing propane refrigerant is used to cool the waxy oil feed. The oil/solvent liquid is further cooled and additional wax crystallized in the later used heat exchangers. As before, the surfaces of the heat exchanger are continually scraped to remove crystallized wax and to maintain the wax dispersed in the oil/solvent liquid.

The wax can be separated from the cold oil/solvent/wax mixture by filtration or centrifugation.

The cold oil/solvent/wax mixture flows from the double pipe heat exchangers to an injected dilution solvent step and then to a rotary drum vacuum filter in which a compartmentalized cloth covered drum rotates, partly submerged in enclosed filter cases in which the wax is separated from the oil/solvent liquid.

A wax-free oil/solvent filtrate solution is drawn through the filter cloth to filtrate tanks in which a vacuum which induces filtration is maintained. A wax cake is deposited upon the drum filter cloth during filtration and is washed on the filter cloth continuously and automatically with cold solvent to produce a low oil content wax product. The wax cake is then removed from the filter cloth and recovered for further processing.

The principal features of the dewaxing process of the present invention are the large amount of solvent that is recovered by the selective permeable membrane for recycle directly to the filter feed, the temperature of the cold oil/solvent filtrate from which the solvent is selectively removed and the total volume of dilution solvent to oil, i.e. total solvent/oil ratio available to carry out the dewaxing process. The amount of solvent that is transferred from the oil/solvent filtrate through the selective permeable membrane for recycle to the filter feed represents solvent that does not have to be recovered from the oil/solvent filtrate by distillation and does not have to be subsequently cooled prior to recycle to the dewaxing process, thus resulting in substantial savings in solvent inventory, distillation capacity and refrigeration capacity. The direct recycle and introduction of the cold solvent from the oil/solvent filtrate into the filter feed provides more efficient use of the available solvent inventory and refrigeration capacity.

The solvent performs the functions of diluent, solvent for the oil, coolant and non-solvent for the wax. The solvent is added to the waxy oil feed at different points along the dewaxing process sequence. The total amount of solvent added is referred to herein as the total solvent/oil ratio and is based on the total volume of solvent added to the waxy oil feed during the dewaxing process. The total solvent to oil dilution ratio can be 6:1 to 1:1 and depends primarily on the type of waxy oil feed and the desired dewaxed oil pour point.

The dewaxing temperature is dependent upon the desired pour point of the dewaxed oil and is typically a few degrees below the pour point, for example, 5° to 10° F. below the pour point. The pour point is also dependent on the type of oil feed.

DETAILED DESCRIPTION OF THE INVENTION

A detailed description of the process of the present invention is given with reference to the FIG. 1 of the drawing. A waxy oil feed, after removal of aromatic compounds by convention phenol or furfural extraction, is fed through line 1 at a temperature of about 130° to 200° F. and is mixed with MEK/toluene solvent fed through line 2 at a temperature of 100° to 140° F. from the solvent recovery section, not shown. The solvent is added at a volume ratio of 0.5 to 3.0 solvent per part of waxy oil feed. The waxy/oil solvent mixture is fed to heat exchanger 3 and heated by indirect heat exchange to a temperature above the cloud point of the mixture of about 140° to 210° F. to insure that all wax crystals are dissolved and in true solution. The warm oil/solvent mixture is then fed through line 4 to heat exchanger 5 in which it is cooled to a temperature of about 100° to 180° F.

The waxy oil feed in line 100 is then mixed directly with solvent at a temperature of 40° to 140° F. fed through line 101 to cool the feed to a temperature of 40° to 140° F., depending on the viscosity, grade and wax content of the waxy oil feed. The solvent is added to the waxy oil feed through line 101 in an amount of 0.5 to 2.0 parts by volume per part of waxy oil in the feed. The temperature and solvent content of the cooled waxy oil feed stream in line 100 is controlled at a few degrees above the cloud point of the oil feed/solvent mixture to preclude premature wax precipitation. A typical target temperature for the feed in line 100 would be 40°–140° F.

The cooled waxy oil feed and solvent are fed through line 100 to scraped-surface double pipe heat exchanger 9A. The cooled waxy oil feed is further cooled by indirect heat exchange in heat exchanger 9A against cold filtrate fed to the heat exchanger 9A through line 111. It is in heat exchanger 9A that wax precipitation typically first occurs. The cooled waxy oil feed is withdrawn from exchanger 9A by line 102 and is injected directly with additional cold solvent feed through line 104. Temperature of the initial cold solvent permeate injection stream 104 can be utilized from indirect cooling of the wax/oil/solvent mixture in unit 9B to bring the injection stream temperature close to that of the waxy stream 102, preferably at $\Delta T<5°$ C. to prevent shock cooling and excess fine wax crystal formation during the early stages of dewaxing. The cold solvent is injected through line 104 into line 102 in an amount of 0 to 1.5, e.g. 0.1 to 1.5, parts by volume based on one part of waxy oil feed. The waxy oil feed is then fed through line 102 to heat exchanger 9B and is further cooled by indirect heat exchange to warm solvent fed to the heat exchanger 9B through line 104 to the desired temperature. The cooled waxy oil feed is withdrawn from exchange 9B by line 105 and is injected directly with additional cold solvent through line 106. The cold solvent injected through line 106 into line 105 is in an amount of 0–1.0, e.g., 0.1 to 0.5, parts by volume based on one part of waxy oil feed. The waxy oil feed is then fed through line 105 to direct heat exchanger 10 and is further cooled against vaporizing propane in scraped-surface, double pipe heat exchanger 10 in which additional wax is crystallized from solution. The cooled waxy oil feed is then fed through line 107 and mixed with additional cold solvent injected directly through line 108. The cold solvent is fed through line 108 in an amount of 0.1 to 3.0, e.g. 0.5 to 1.5, parts by volume per part of waxy oil feed. The final injection of cold solvent at or near the filter feed temperature through line 108 serves to adjust the solids content of the oil/solvent/wax mixture feed to the filter 11 to 3 to 10 volume percent, in order to facilitate filtration and removal of the wax from the waxy oil/solvent/wax mixture feed to the filter 11. The mixture is then fed through line 109 to the filter 11 and the wax is removed. The temperature at which the oil/solvent/wax mixture is fed to the filter is the dewaxing temperature and can be −10° to +20° F. (−23° to −7° C.) and determines the pour point of the dewaxed oil product.

One or more filters 11 can be used and they can be arranged in parallel or in a parallel/series combination. A separated wax is removed from the filter through line 113 and is fed to indirect heat exchanger 13 to cool solvent recycled from the solvent recovery operation. The cold filtrate is removed from filter 11 through line 110 and at this point contains a solvent to oil ratio of 15:1 to 2:1 parts by volume and is at a typical temperature of −10° to +50° F.

The cold filtrate in line 110 is increased in pressure and fed through line 110 to selective permeable membrane module M1 at the filtration temperature. The membrane module M1 contains a low pressure solvent permeate side 6 and a high pressure oil/solvent filtrate side 8 with the selective permeable membrane 7 in between. The cold oil/solvent filtrate at the filtration temperature is fed through line 110 to the membrane module M1. The membrane 7 allows the cold MEK/tol solvent from the oil/solvent filtrate side 8 to selectively permeate through the membrane 7 into the low pressure permeate side 6 of the membrane module. The cold solvent permeate is recycled to filter feed lines 102, 105, and 107.

The solvent selectively permeates through the membrane 7 in an amount of 0.1 to 4.5 parts by volume per part of waxy oil in the feed.

About 10 to 100%, typically 20 to 75% and more typically 25 to 60% by volume of the MEK/tol. solvent in the cold filtrate permeates through the membrane and is recycled to the filter feed lines. The removal of cold solvent from the filtrate and the recycle of the removed solvent to the filter feed reduces the amount of solvent needed to be recovered from the oil/solvent filtrate and reduces the amount of heat required to subsequently heat and distill the solvent from the filtrate in the solvent recovery operation, respectively. Higher oil filtration rates and lower oil-in-wax contents are obtained as a result.

The filtrate side of the membrane is maintained at a positive pressure of about 200–1000 psig and preferably 400–800 psig greater than the pressure of the solvent permeate side of the membrane to facilitate the transport of solvent from the oil/solvent filtrate side of the membrane to the solvent permeate side of the membrane. The solvent permeate side of the membrane is typically at 0–600 psig, preferably 10–100 and more preferably 10–50, for example at about 25 psig.

The membrane 7 has a large surface area which allows very efficient selective solvent transfer through the membrane.

The cold filtrate removed from the membrane module M1 is fed through line 111 to indirect heat exchanger 9A, in which it is used to indirectly cool warm waxy oil feed fed through line 100 to the heat exchanger 9A. The amount of solvent to be removed by the membrane module M1 is determined, to some extent, by the feed pre-cooling requirements. The cold filtrate is then fed through line 112 to an oil/solvent separation operation in which the remaining solvent is removed from the dewaxed oil.

The solvent is separated from the oil/solvent filtrate in the oil/solvent recovery operation, not shown, by heating and removing the solvent by distillation. The separated solvent is recovered and returned through line 2 to the dewaxing process. The wax and solvent free oil product is recovered and used as lubricating oil stock.

A portion of the solvent from the solvent recovery operation is fed through line 2 at a temperature of about 100° to 140° F. to be mixed with waxy oil feed fed through line 1. Another portion of the recovered solvent is fed through line 2 to line 16 and into heat exchangers 17 and 13 in which the solvent is cooled to about the dewaxing temperature by indirect heat exchange against either cooling water or propane and wax/solvent mixture, respectively. Another portion of the recovered solvent is fed through lines 2, 16 and 14 to heat exchanger 15 in which it is cooled by indirect heat exchange with cold refrigerant, e.g. vaporizing propane, to about the fluid temperature in line 107 and fed through line 106 and injected into the oil/solvent/wax mixture in line 105 and/or 107.

DESCRIPTION OF PREFERRED EMBODIMENTS

Light Neutral Lubricating Oil Feed Stock

A light lubricating oil feed boiling in the range of 550° to 1000° F., preferably 570° to 900° F. and more preferably 580° to 850° F., is treated to remove aromatic compounds and is pre-diluted with solvent, heated to melt wax crystals and cooled. A MEK/tol. solvent is used at a ratio of MEK/tol. of 25:75 to 100:0, preferably 60:40 to 90:10, and more preferably 70:30 to 80:20.

The total solvent to oil dilution ratio is 6:1 to 1:1, preferably 5:1 to 2:1, and more preferably 4:1 to 2:1.

The dewaxing temperature, i.e, the temperature at which the oil/solvent/wax mixture is fed to the filter, is −20° to +70° F., preferably −10° to +30° F., and more preferably −10° to +10° F.

The oil/solvent filtrate from the filter contains a ratio of solvent to oil of 6:1 to 1:1, preferably 5:1 to 3:1.

The oil/solvent filtrate is fed to the membrane module M1 at the dewaxing temperature. The operating temperature of the selective membrane can be −20° to +70° F., preferably −10° to +30° F., and more preferably −10° to +10° F.

The oil/solvent filtrate side of the membrane is maintained at a positive pressure relative to the solvent permeate side of the membrane of 200 to 1000 psig, preferably 400 to 800 psig, and more preferably 500 to 700 psig. The solvent permeate side of the membrane is typically maintained at a pressure of 10 to 50 psig.

There is transferred through the membrane module M1 10 to 100 vol. % of the solvent in the oil/solvent filtrate stream, preferably 20 to 75 vol. %, and more preferably 25 to 60 vol. %.

A sufficient amount of solvent is transferred through the membrane to add 0.1 to 2.0 parts and preferably 0.5 to 1.9 parts of solvent per part of oil feed to the filter feed.

A dewaxed oil is obtained having a pour point of −20° to +70° F. preferably −10° to 30° F., and more preferably −5° to +10° F.

Heavy Neutral Lubricating Oil Feed Stock

A heavy neutral lubricating oil feed boiling in the range of 700° F. to 1300° F., preferably 800° to 1150° F., and more preferably 850° to 1050° F. is treated to remove aromatic compounds and is pre- diluted with solvent, heated to melt wax crystals and cooled. A MEK/tol. solvent is used at a ratio of MEK/tol. of 25:75 to 100:0, preferably 50:50 to 70:30 and more preferably 55:45 to 65:35.

The total solvent to oil dilution ratio is 6:1 to 1:1, preferably 4:1 to 2:1, and more preferably 4:1 to 3:1.

The dewaxing temperature, i.e, the temperature at which the oil/solvent/wax mixture is fed to to the filter, is −20° to +70° F., preferably 0° to 50° F., and more preferably 10° to 20° F.

The oil/solvent filtrate from the filter contains a ratio of solvent to oil of 6:1 to 1:1, preferably 5:1 to 2:1 and more preferably 5:1 to 3:1.

The oil/solvent filtrate is fed to the membrane module M1 at the dewaxing temperature.

The operating temperature of the selective membrane can be −20° to +70° F., preferably 0° to 50° F., and more preferably 10° to 20° F.

The oil/solvent filtrate side of the membrane is maintained at a positive pressure relative to the solvent permeate side of the membrane of 200 to 1000 psig, preferably 400 to 800 psig, and more preferably 500 to 700 psig.

There is transferred through the membrane module M1 10 to 100 vol. % of the solvent in the oil/solvent filtrate stream, preferably 20 to 75 vol. % and more preferably 25 to 60 vol. %.

A sufficient amount of solvent is transferred through the membrane to add 0.1 to 3.0 parts, preferably 1.0 to 2.5 parts of solvent per part of oil feed to the filter feed.

A dewaxed oil is obtained having a pour point of −10° to +70° F., preferably 10° to 60° F., and more preferably 15° to 30° F.

Deasphalted Lubricating Oil Feed Stock

A deasphalted lubricating oil feed boiling in the range of 600° to 2500° F., preferably 900° to 1500° F., and more preferably 1050° to 1300° F. is treated to remove aromatic compounds and is pre-diluted with solvent, heated to melt wax crystals and cooled. A MEK/tol. solvent is used at a ratio of MEK/tol. of 25:75 to 100:0, preferably 45:55 to 70:30 and more preferably 50:50 to 65:35.

The total solvent to oil dilution ratio is 6:1 to 1:1, preferably 5:1 to 2:1, and more preferably 5:1 to 3:1.

The dewaxing temperature, i.e, the temperature at which the oil/solvent/wax mixture is fed to to the filter, is −20° to +70° F., preferably 0° to 50° F., and more preferably 10° to 30° F.

The oil/solvent filtrate from the filter contains a ratio of solvent to oil of 6:1 to 1:1, preferably 5:1 to 2:1 and more preferably 5:1 to 3:1.

The oil/solvent filtrate is fed to the membrane module M1 at the dewaxing temperature.

The operating temperature of the selective membrane can be −20° to +70° F., preferably 0° to 50° F., and more preferably 10° to 30° F.

The oil/solvent filtrate side of the membrane is maintained at a positive pressure relative to the permeate solvent side of the membrane of 200 to 1000 psig, preferably 400 to 800 psig, and more preferably 500 to 700 psig.

There is transferred through the membrane module M1 10 to 100 vol. % of the solvent in the oil/solvent filtrate stream, preferably 20 to 75 vol. % and more preferably 25 to 60 vol. %.

A sufficient amount of solvent is transferred through the membrane to add 0.1 to 3.0 parts, preferably 1.0 to 2.5 parts of solvent per part of oil feed to the filter feed.

A dewaxed oil is obtained having a pour point of −10° to +70° F. preferably 10° to 60° F., and more preferably 20° to 30° F.

Though the process and economic advantages of the present invention have been described as they apply to solvent lube dewaxing using MEK/toluene solvent, the invention can also be utilized in a similar manner in other solvent dewaxing systems, such as in propane dewaxing.

The dewaxed oil can be used as lubricating oil stock.

The present invention is illustrated by the following Examples.

EXAMPLE 1

A light neutral lubricating oil feed boiling in the range of 650° to 840° F. is treated to remove undesirable aromatic compounds and is prediluted with solvent, is heated to melt wax crystals and is cooled. The waxy oil feed is then fed to the dewaxing process at a rate of 14,000 barrels a day based on oil feed. The solvent consists of a ratio of MEK/tol. of 70:30. The total solvent to oil dilution ratio is 4:1 based on volume. The dewaxing temperature, i.e., the oil/solvent/wax mixture feed to the filter temperature is −5° F. The filter removes the wax from the oil/solvent/wax mixture. A cold wax cake is recovered and a cold oil/solvent filtrate stream is recovered. The cold oil/solvent filtrate stream is fed to the membrane module M1.

The membrane is prepared in accordance with the procedure of White et al (U.S. Pat. No. 5,264,166), incorporated by reference. The membrane is incorporated in a spiral wound module having high surface area and low propensity for fouling. The module comprises layers of the membrane wound upon a perforated metal resistant tube. The membrane layers are separated by alternate layers of permeate and retentate spacers sized to provide an acceptable pressure drop from inlet to outlet of about 2 to 10 psig. Adhesives and sealants are used to maintain separate permeate and retentate flow channels. The modules are constructed to be 8 inches in diameter and 48 inches in length and to have a 200 to 300 $ft^2$ surface area. 1000 modules are used. The solvent permeate feed rate for each module is 1,100 gal/day.

The oil/solvent filtrate stream is fed to the membrane module at a rate of 50,400 barrels a day of solvent and 10,500 barrels a day of dewaxed oil.

The oil/solvent filtrate stream side of the membrane is maintained at a positive pressure of 650 psig and the solvent permeate side of the membrane is maintained at about 25 psig. About 25,000 barrels a day of cold solvent is selectively transferred through the membrane. About 8,000 barrels a day of solvent is routed through the double pipe exchangers while 6,000 and 11,000 barrels a day are injected ahead of and downstream respectively of the double pipe chillers.

There is recovered about 10,500 barrels a day of dewaxed oil having a pour point of +5 and, after further conventional treatment, 3500 barrels a day of slack wax having an oil content of 10 to 25 vol. % oil.

The process of the present invention results in substantial savings in distillation capacity to recover solvent from filtrate and in refrigeration capacity to cool the warmed separated solvent from the solvent/oil recovery operation to the necessary dewaxing temperature. In addition, there are improvements in heat exchange rates in the scraped surface exchangers and significant savings in solvent inventory requirements.

In order to illustrate the savings achieved by the practice of the present invention, a comparison is made between the process of the present invention, in which a selective membrane is used, and the prior art process without the selective membrane.

The process of the present invention, as compared to the prior art process to obtain the same level of dewaxing and pour point oil, achieves about a 40% reduction in the size and capacity of the oil/solvent recovery section and about a 50% reduction in the heat energy required to carry out solvent recovery as well as an about 45% reduction in the total refrigeration requirements. Waxy oil feed rate increases of about 15% are obtained due to greater cold solvent availability and improved heat transfer rates in the scraped surface exchangers.

The total refrigeration requirements include the refrigeration required to cool the feed and crystallize wax from the feed, e.g., the refrigeration needed for the scraped-surface heat exchangers, as well as the refrigeration required to cool the warm distilled solvent from the solvent recovery operation to the dewaxing temperature.

EXAMPLE 2

A heavy neutral lubricating oil feed boiling in the range of 850° to 1050° F. is treated to remove undesirable aromatic compounds and is prediluted with solvent, is heated to melt wax crystals and is cooled. The waxy oil feed is then fed to the dewaxing process at a rate of 11,000 barrels a day based on oil feed.

The solvent consists of a ratio of MEK/tol. of 65:35. The total solvent to oil dilution ratio is 4:1 based on volume.

The dewaxing temperature, i.e. the feed to the filter temperature, is +10° F.

The filter removes the wax from the oil/solvent/wax mixture. A cold wax cake is recovered and a cold oil/solvent filtrate stream is recovered. The cold oil/solvent filtrate stream is fed to the membrane module M1.

The membrane and module are the same as that of Example 1.

The oil/solvent filtrate stream is fed to the membrane module at a rate of 46,200 barrels a day of solvent and 8,800 barrels a day of dewaxed oil.

The oil/solvent filtrate stream side of the membrane is maintained at a positive pressure of 650 psig and the solvent permeate side of the membrane is maintained at about 25 psig. About 23,000 barrels a day of cold solvent is selectively transferred through the membrane. About 8,000 barrels a day of solvent is routed through the double pipe exchangers while 8,000 and 7,000 barrels a day are injected upstream and downstream respectively of the scraped surface chillers.

There is recovered about 8,800 barrels a day of dewaxed oil having a pour point of 20° F. and, after further conventional treatment, 2,200 barrels a day of slack wax having an oil content of 15 to 35 vol. % oil.

The process of the present invention results in substantial savings in distillation capacity to recover solvent from filtrate and refrigeration capacity to cool the warmed separated solvent from the solvent/oil recovery operation to the necessary dewaxing temperature. In addition, there are considerable savings in solvent inventory requirements.

In order to illustrate the savings achieved by the practice of the present invention, a comparison is made between the process of the present invention, in which a selective membrane is used, and prior art process without the selective membrane.

The process of the present invention, as compared to the prior art process to obtain the same level of dewaxing and pour point oil, achieves an about 40% reduction in the size and capacity of the oil/solvent recovery section and an about 45% reduction in the heat energy required to carry out solvent recovery as well as an about 40% reduction in the total refrigeration requirements. Waxy oil feed rate increases by about 12% due to greater solvent availability and higher heat transfer rates in the scraped surface exchanger.

EXAMPLE 3

A deasphalted lubricating oil feed boiling in the range of 1050° to 1240° F. is treated to remove undesirable aromatic compounds and is prediluted with solvent, is heated to melt wax crystals and is cooled. The waxy oil feed is then fed to the membrane module at a rate of 10,000 barrels a day based on oil feed.

The solvent consists of a ratio of MEK/tol. of 50:50. The total solvent to oil dilution ratio is 5.5:1 based on volume.

The dewaxing temperature, i.e. the feed to the filter temperature, is 15° F.

The filter removes the wax from the oil/solvent/wax mixture. A cold wax cake is recovered and a cold oil/solvent filtrate stream is recovered. The cold oil/solvent filtrate stream is fed to the membrane module M1.

The membrane and module are the same as that of Example 1.

The oil/solvent filtrate stream is fed to the membrane module at a rate of 51,600 barrels a day of solvent and 7,800 barrels a day of dewaxed oil.

The oil/solvent filtrate stream side of the membrane is maintained at a positive pressure of 650 psig and the solvent permeate side of the membrane is maintained at about 25 psig. About 24,000 barrels a day of cold solvent is selectively transferred through the membrane. About 10,000 barrels a day of solvent is routed through the scraped surface exchangers while 14,000 barrels a day are injected upstream of the scraped surface chillers.

There is recovered about 7,800 barrels a day of dewaxed oil having a pour point of 25° F. and, after further conventional treatment, about 2100 barrels a day of slack wax having an oil content of 10 to 15 vol. % oil.

The process of the present invention results in substantial savings in distillation capacity to recover solvent from filtrate and in refrigeration capacity to cool the warmed separated solvent from the solvent/oil recovery operation to the necessary dewaxing temperature. In addition, there are considerable savings in solvent inventory requirements.

In order to illustrate the savings achieved by the practice of the present invention, a comparison is made between the process of the present invention, in which a selective membrane is used, and the prior art process without the selective membrane.

The process of the present invention, as compared to the prior art process to obtain the same level of dewaxing and pour point oil, achieves an about 35% reduction in the size and capacity of the oil/solvent recovery section and an about 30% reduction in the heat energy required to carry out solvent recovery as well as an about 30% reduction in the total refrigeration requirements. Waxy oil feed rate increases by about 8% due to greater solvent circulation.

Several benefits are obtained by the solvent dewaxing process of the present invention. The solvent transferred from the filtrate through the selective permeable membrane and recycled to the filter feed does not have to be either heated in the oil/solvent recovery distillation system to separate the solvent or have to be subsequently cooled prior to recycle to the dewaxing process. More solvent is available to be added to the filter feed since the distillation recovery and/or refrigeration bottlenecks are significantly reduced or eliminated.

The amount of solvent which is made to selectively permeate through the membrane and recycled to the process is limited only by the size and permeability of the membrane and the hydraulic capacity of the rotary filters. As a result of using a selective permeable membrane to separate and directly recycle cold solvent to the process, the internal solvent circulation rate can be substantially increased and can be larger than the flow rate of the solvent recovered from the oil/solvent distillation recovery operation that is recycled to the dewaxing process in a conventional dewaxing process.

The reduction in the viscosity of the oil/solvent/wax feed to exchangers 9A, 9B, and 10, and the filter, due to the higher availability of solvent achieved by the present invention, leads to an increase in the heat transfer rate to the feed and an increase in the maximum feed rate to the filters. The higher solvent/oil ratio also contributes to higher oil yields on the filters and greater filter feed rates for heavy stocks which are generally filter area limited.

Introduction of additional solvent at the feed mix temperature avoids shock chilling, thus reducing oil occlusion in the wax crystals and further improving oil yield.

The selective removal of solvent from the dewaxed oil/solvent filtrate stream by the selective permeable membrane can significantly reduce the distillation capacity required and the cost of removing the remaining solvent in the filtrate stream and reduce the capacity required and cost of subsequently cooling the separated distilled solvent to the dewaxing temperature.

A principal advantage of the use of the selective permeable membrane in accordance with the present invention is that it provides the selective separation of cold solvent from the cold oil/solvent filtrate stream and recycle of the separated solvent at the filtration temperature directly to the filter feed stream.

The incremental cooling and concurrent solvent addition can be programmed by stream sampling and flow control techniques, and controlled by conventional industrial instrumentation. Linear or non-linear recycle solvent injection rates can be employed. Proportional control of fluid handling equipment is effective for achieving optimum crystalliztion and phase separation.

It is preferred to inject the cold recycle solvent into the waxy feedstock stream by increments of less than 50 volume percent (vol %) of total cold solvent permeate recycle. By Splitting the cold recycle permeate stream into multiple injection streams (ie, at least three portions of equal or unequal flow rate), incremental cooling and controlled crystallization is achieved. For light oil stocks, it is preferred to add about 15–25% of total cold recycle solvent in the initial injection stage; however, heavier stocks may be injected with 25–50 vol % or more of the internally circulated cold solvent permeate.

Advantages are obtained by the present process in maintaining a high ratio of internally circulated cold solvent permeate to warmer solvent recovered from the oil-rich retentate stream by vaporizing/distilling the dewaxed product. This ratio is maintained at greater than 3:1 up to 5:1 or more by operating the cold membrane separation step at a high flux rate. Since conventional flash vaporization and distillation recovery of fresh solvent is energy intensive as compared to membrane separation of the cold recycle permeate stream, significant economic benefits are obtained by recovering typically 75 vol % or more of solvent from the oil-solvent filtrate stream by permeation.

Increased solvent throughput permits an adequate amount of solvent to remain in the retantate to maintain fluidity. This results in better heat exchange in the feedstock pre-cooler stage (9A). For example, a typical retantate stream can have 25 vol % or more solvent.

Temperature differential between the waxy stream and cold recycle solvent should be less than 5° C. (preferably $\Delta T<3°$ C.) in the first cold solvent injection stage. This controls crystallization rates and prevents formation of an excess number of small wax crystals, thus assuring growth of easily filtered large wax particles.

While the invention has been illustrated by reference to specific embodiments and examples, it will be apparent to those skilled in the art that various changes and modifications may be made which fall within the scope of the invention. The scope of the invention is to be interpreted and construed in accordance with the attached claims.

What is claimed is:

1. A process for solvent dewaxing a waxy petroleum oil feed stream comprising the steps of:

diluting of the waxy oil feed stream with solvent;

cooling the waxy oil feed stream in successive heat exchange stages to a temperature of 40° to 140° F., and further cooling the waxy oil feed by indirect contact with cold filtrate by sequentially indirectly cooling the waxy oil feed in indirect heat exchangers to crystallize and precipitate wax crystals and sequentially directly injecting additional solvent in incrementally colder solvent injection stages into the waxy oil feed stream to further cool and dilute and to obtain a desired viscosity of the waxy oil feed stream to facilitate handling of the waxy oil feed stream through the process and to facilitate filtering crystallized wax from the waxy oil feed and to obtain the desired pour point of dewaxed oil product, and during the sequential cooling of the waxy oil feed crystallizing and precipitating wax from the waxy oil feed to obtain an oil/solvent/wax mixture at a temperature of −30° to +70° F.;

feeding the oil/solvent/wax mixture to a filter to remove the wax and obtain an oil/solvent filtrate stream, contacting the oil/solvent filtrate stream at a temperature of −30° to +70° F. with one side of a selective semipermeable membrane in a membrane module to selectively transfer solvent through the membrane to obtain a solvent permeate stream on the other side of the membrane, the oil/solvent filtrate stream side of the membrane is maintained at a positive pressure relative to a pressure on the solvent permeate side of the membrane; and wherein the volume ratio of solvent in the permeate stream to retentate stream is 1:1 to 3:1;

selectively transferring a major amount of solvent from the filtrate side of the membrane to the solvent permeate side of the membrane, and recycling the solvent permeate at a temperature of −30° to +70° F. to the filter feed, withdrawing a filtrate stream containing the remaining solvent from the filtrate side of the membrane module, contacting the filtrate stream by indirect heat exchange with the warm waxy oil feed; and treating the withdrawn filtrate stream to separate the remaining solvent from the oil, and recovering a dewaxed oil product stream, and a slack wax product stream and recycling the separated solvent to the dewaxing process.

2. The process of claim 1 wherein the solvent to oil ratio in the oil/solvent filtrate stream is 15:1 to 3:1 based on volume, and wherein the dewaxing solvent is MEK/tol. and the ratio of MEK to tol. is 25:75 to 100:0.

3. The process of claim 1 wherein the membrane transfer temperature is −30° to +70° F., wherein the total solvent to oil dilution ratio is 6:1 to 1:1, wherein the pour point of the dewaxed oil obtained is −20° to 70° F., and wherein the waxy oil feed is a light neutral lubricating oil stock having a boiling range of 580° to 850° F.

4. The process of claim 1 wherein the waxy oil feed is a heavy neutral lubricating oil stock having a boiling range of 850° to 1050° F.

5. The process of claim 1 wherein the waxy oil feed is a deasphalted lubricating oil stock having a boiling range of 1050° to 1300° F.

6. A process for solvent dewaxing a waxy petroleum oil feed to obtain petroleum oil lubricating stock comprising the steps of: contacting a warm waxy oil feed by indirect heat exchange with a portion of cold filtrate and with refrigerant to crystallize and precipitate the wax in the oil feed, thereby forming a multiphase oil/solvent/wax mixture;

diluting the oil/solvent/wax mixture with cold solvent to adjust the viscosity of the mixture and feeding the mixture to a filter for removing the wax from the cold oil/solvent/wax mixture and recovering a cold wax cake and a cold oil/solvent filtrate stream;

feeding the cold oil/solvent filtrate stream under pressure substantially at filtration temperature to a selective permeable membrane for selectively separating the cold filtrate into a cold solvent permeate stream and a cold oil-rich retentate stream which contains the dewaxed oil and the remaining solvent;

splitting the cold solvent permeate stream at the filtration temperature into a first split stream for recycle an injection in the filter feed stream, and a second split stream for use in parallel with the cold filtrate stream to cool the warm waxy oil feed by indirect heat exchange;

passing the retentate stream, after heat exchange with the warm waxy oil feed, to an oil/solvent separation operation in which residual solvent is removed from the dewaxed oil and recycled to the dewaxing process and the wax free lubricating oil stock product is recovered; and employing the now warm solvent stream for direct dilution of waxy feed.

7. In the process for solvent dewaxing a waxy petroleum oil feed according to claim 6; wherein the oil feed is cooled and diluted by direct injection of cold recycle solvent permeate from the membrane recovery operation; and wherein the initial cold recycle solvent is injected at a temperature differential less than 9° F. to control crystal formation.

8. In the process for solvent dewaxing petroleum feedstock to separate crystallized wax from lubricant oil by filtration of a wax/oil/solvent mixture, wherein the feedstock is sequentially cooled and mixed with cold polar solvent to form a wax crystal phase and oil-solvent phase, and wherein an oil-solvent filtrate stream is contacted with solvent permeable selective membrane to recover an internal circulating solvent stream and an oil-rich retentate stream containing dewaxed oil product and residual solvent; the improvement which comprises: splitting the internal circulating solvent stream into multiple cold recycle streams and injecting a plurality of said cold recycle solvent streams into the waxy petroleum feedstock during sequential cooling and mixing, including initially injecting a cold recycle solvent stream into the waxy petroleum feedstock at small temperature differential between streams and near the wax crystallization temperature.

9. In the process for solvent dewaxing petroleum feedstock according to claim 8, wherein warm waxy feedstock is cooled by indirect heat exchange with cold filtrate to precool the feedstock to near wax crystallization temperature; wherein the feedstock is first diluted with relatively warm solvent from residual solvent recovered from dewaxed oil, cooled by indirect heat exchange with said residual solvent and with cold refrigerant wherein the partially diluted feedstock is then further cooled and diluted by direct injection of cold recycle solvent permeate from the membrane recovery operation.

10. In the process for solvent dewaxing petroleum feedstock according to claim 8, wherein the initial cold recycle solvent is injected at a small temperature differential to control crystal formation, and wherein the volume ratio of solvent in the permeate stream to volume in the retentate stream is 1:1 to 3:1.

11. In the process for solvent dewaxing petroleum feedstock according to claim 10, wherein a temperature differential less than 9° F. is achieved by precooling the waxy feedstock at or near the wax crystallization temperature, while passing the cold recycle solvent permeate stream in indirect heat exchange with downstream oil/wax/solvent mixture, thus warming the injected recycle solvent to slightly below wax crystallization temperature prior to initial injection, whereby the waxy oil feed is sequentially cooled and diluted to its desired wax filtration temperature to produce large wax crystals.

* * * * *